United States Patent [19]

Sato et al.

[11] 4,137,438

[45] Jan. 30, 1979

[54] LEVER SWITCH

[75] Inventors: Hidetoshi Sato; Masao Ohkita, both of Furukawa, Japan

[73] Assignee: Alps Electric Co., Ltd., Japan

[21] Appl. No.: 859,686

[22] Filed: Dec. 12, 1977

[30] Foreign Application Priority Data

Dec. 13, 1976 [JP] Japan ..... 51-166893[U]

[51] Int. Cl.[2] ..... H01H 3/00; H01H 15/18; H01H 1/36

[52] U.S. Cl. ..... 200/153 H; 200/153 L; 200/76; 200/252; 200/332

[58] Field of Search ..... 200/153 L, 153 LA, 67 R, 200/67 A, 76, 164 R, 164 A, 252, 332, 335, 153 H, 153 G, 292, 293, 303

[56] References Cited

U.S. PATENT DOCUMENTS

| | | | |
|---|---|---|---|
| 2,085,217 | 6/1937 | Hart | 200/67 A |
| 2,626,335 | 1/1953 | Landin | 200/153 L |
| 3,272,951 | 9/1966 | O'Brien | 200/292 X |

FOREIGN PATENT DOCUMENTS

| | | |
|---|---|---|
| 84080 | 7/1976 | Japan. |
| 86570 | 7/1976 | Japan. |
| 130879 | 11/1976 | Japan. |

*Primary Examiner*—William Price
*Assistant Examiner*—Steven M. Pollard
*Attorney, Agent, or Firm*—Guy W. Shoup; Gerard F. Dunne

[57] ABSTRACT

Disclosed is a lever switch for switching electric circuits. The switch has a driving lever rotatably secured to a switch frame which accomodates a slider having movable contacts and a click container accomodating a click member. The slider has a driving portion adapted for engagement with a driving projection formed on the driving lever, so that the slider may be driven to bring the movable contacts housed therein into and out of contact with fixed contacts, thereby to switch the electric circuits. The click member is adapted for engagement with a cam portion of the driving lever to allow the clicking motion of the latter. The click container is fixed to the switch frame in such a manner that grooves formed at the sides thereof receive corresponding tongues formed on the switch frame, so that it is unnecessary to spread the walls of the frame away from each other during the insertion of the click container, thereby to facilitate the assembling.

1 Claim, 5 Drawing Figures

LEVER SWITCH

BACKGROUND OF THE INVENTION

The present invention relates to a construction of a lever switch for electric circuits.

There have been proposed various lever switches which typically have a driving lever rotatably secured to a switch frame and adapted to drive a slider housed in the frame so as to bring a movable contact selectively into contact with fixed contacts, thereby to switch electric circuits. Examples of such lever switches are shown in Japanese laid-open Patent applications Nos. 84080/76 and 130879/76, and Japanese laid-open Utility Model application No. 86570/76.

However, as will be mentioned later, these conventional switches are all difficult and require too much time to assemble.

It is therefore an object of the present invention to provide an improved lever switch for electric circuits, of the kind described, which can be assembled easily in a shorter time.

SUMMARY OF THE INVENTION

To this end, according to the present invention, there is provided a lever switch comprising a driving lever rotatably secured to a switch frame, said driving lever having a driving tab or projection adapted for engagement with a driving part of a slider accomodated in said switch frame. A cam portion is also provided on said driving lever for engagement with a click member or detent in a click container, said click container being adapted to be attached to said switch frame by positioning a tongue provided on the back portion of said switch frame in a groove provided in said click assembly.

The above and other objects, as well as advantageous features of the invention will become clear from the following description of a preferred embodiment taken in conjunction with the attached drawings in which:

BRIEF DESCRIPTION OF THE DRAWINGS

FIGS. 1 to 3 show a typical conventional lever switch, wherein FIGS. 1*a* and 1*b* are sectional views of essential parts of the switch, FIG. 2 is a perspective view of a clicking assembly and FIG. 3 is a top plan view of the essential part; and FIGS. 4 and 5 show an embodiment of the present invention wherein FIG. 4 is an exploded perspective view and FIG. 5 is a sectional side elevational view of essential parts.

DESCRIPTION OF THE PREFERRED EMBODIMENT

Before turning to the description of the embodiment of the present invention, for an easier understanding of the improvement in accordance with the present invention, an explanation will be made as to the prior art with specific reference to FIGS. 1 through 3.

Figure 1:
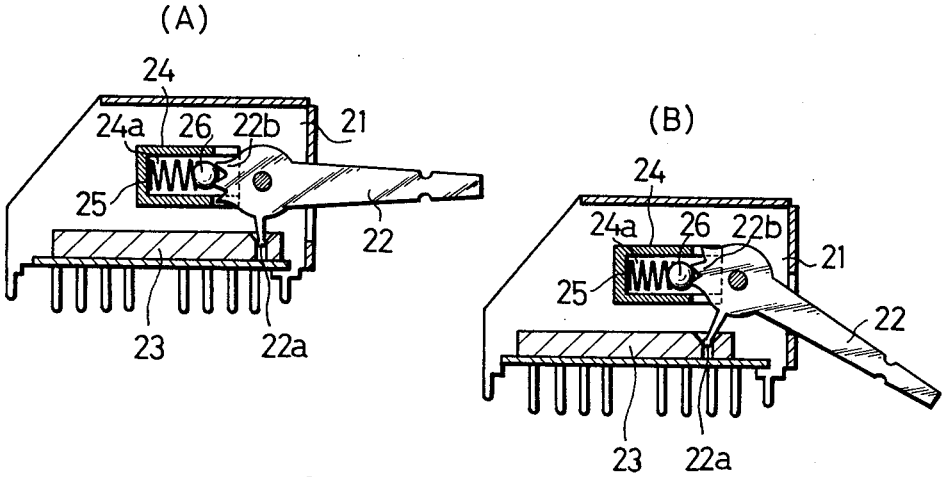
Figure 2:
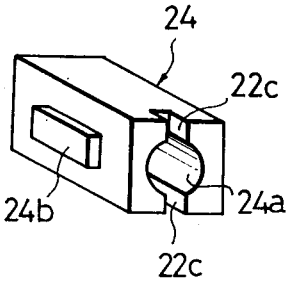
Figure 3:
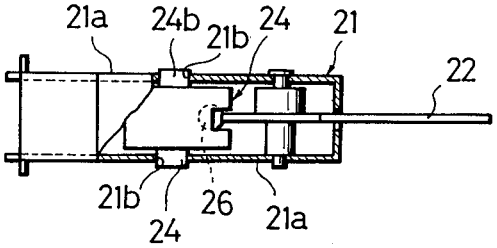

In a typical conventional lever switch as shown in FIGS. 1 through 3, a lever 22 is rotatably secured to a switch frame 21. The lever 22 is provided with a tab or projection 22*a* for engagement with a slider 23 to drive the latter.

A box-shaped click container 24 (See FIG. 2) has a bore or cavity 24*a* for accomodating a coiled spring 25 and a ball 26. Projections 24*b* are formed on respective side surfaces of the click container. One end surface of the click container 24 is notched as at 22*c* and 22*c*, for passing therethrough a cam portion 22*b* of the lever 22, which cam portion is formed unitarily with the lever.

The ball 26 is adapted to engage the cam portion 22*b* of the lever 22 for allowing a clicking rotary motion of the latter for bringing a movable contact in the slider 23 into and out of contact with fixed contacts for switching the electric circuits.

In assembling the lever switch of the described type, the click assembly 24 is inserted into the switch frame 21, with resiliently biasing the side walls 21*a*, 21*a* of the frame 21 outwardly, until the projections 24*b*, 24*b* of the click container 24 come to be received within the corresponding rectangular bores 21*b*, 21*b* formed in the side walls 21*a*, 21*a* of the switch frame.

This manner of assembling brings about a plastic deformation of the switch frame 21, which due to an excessive spreading of the side walls away from each other, often can be recovered only by troublesome time consuming manual work. Thus, the assembling work is very time-consuming and troublesome.

Under these circumtances, the invention aims at overcoming the described drawbacks of the prior art by providing an improved lever switch which can be assembled without necessitating the labor of spreading the switch frame at all.

Figure 4:
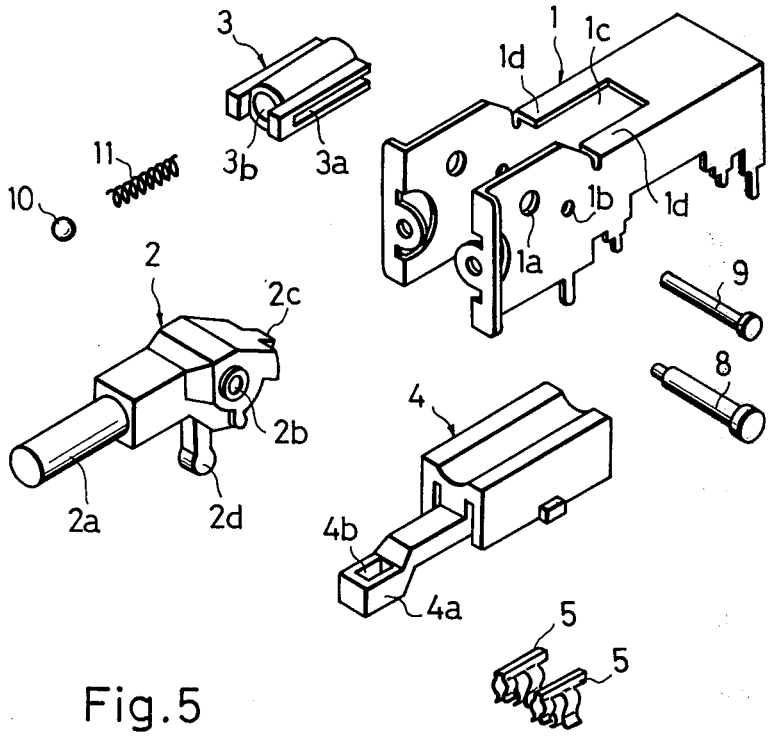
Figure 5:
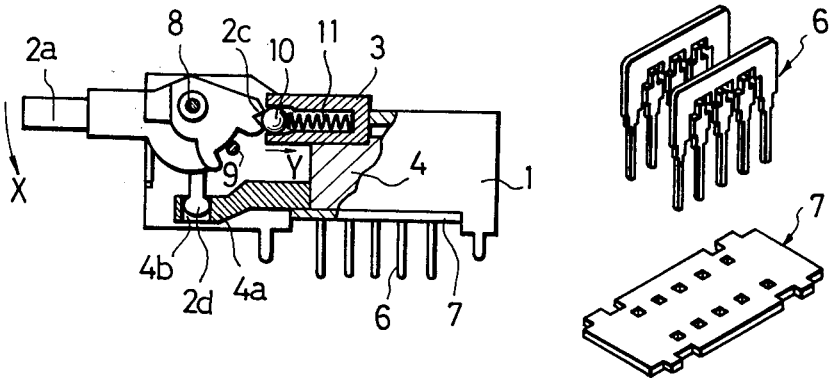

Hereinafter, a preferred embodiment of the invention will be described with reference to FIGS. 4 and 5.

Referring to these Figs., a switch frame 1 is made of a metallic sheet which has been bent to form the frame after having been punched out from a blank. The switch frame 1 has bores 1*a*, 1*b* in its side walls and a pair of tongues 1*d*, 1*d* in the rear portions of the frame, which tongues in combination defined a notch 1*c*.

A driving lever 2 made of a plastics material has a unitary construction including an operating portion 2*a*, a transverse bore 2*b* for passing a supporting shaft therethrough, a cam portion 2*c* for clicking motion and a driving projection 2*d*.

A ball 10 which constitutes a clicking member and a coiled spring 11 are accomodated by a click container 3 which has a groove 3*a* at each side surface thereof. A slider 4 made of a plastics material has a driving portion 4*a* in which is formed a bore 4*b* for engagement with the driving projection 2*d* of the driving lever 2. A pair of movable contacts 5 are provided in the slider 4. Numerals 6 and 7 denote, respectively, fixed terminals and an insulating substrate plate 7.

A shaft 8 is intended for rotatably securing the driving lever 2 to the switch frame 1, while a shaft 9 is provided for limiting the range of rotation of the driving lever 2.

For assembling the lever switch of the present invention, at first the click container 3 is brought into the notched portion 1*c* of the switch frame 1 in such a manner that the grooves 3*a*, 3*a* thereof are brought into alignment with the tongues 1*d*, 1*d* formed at the rear portion of the switch frame 1. Then, after having put the ball 10 and the coiled spring 11 into the click container through an insertion port 3*b*, the driving lever 2 is so positioned that its cam portion 2*c* is put in contact with the ball 10. In this condition, the shaft 8 is inserted through the bores 1*a* of the switch frame 1 and the bore 2*b* of the driving lever 2, so as to complete the attaching of the driving lever 2 to the switch frame 1.

Subsequently, the slider 4 housing the pair of movable contacts 5, 5 in its body is inserted into the switch frame 1, so as to bring the bore 4*b* thereof into engagement with the driving projection 2*d* of the driving lever.

Subsequently, the insulating substrate plate 7 carrying a number of parallel fixed contacts 6 is secured to the switch frame 1. Finally, the shaft 9 is inserted into the bore 1*b* of the switch frame 1 to complete the assembling.

The manner of operation of the switch in accordance with the invention will be briefly described below.

As the operating portion 2*a* of the driving lever 2 is pivoted in the direction of arrow X, th protrusion of the cam portion 2*c* comes to bias the ball 10 in the direction of the arrow Y, so that a clicking or detent motion is given as the ball 10 rides over the protrusion. At the same time, the driving projection 2*d* is rotated around the shaft 8 to cause the movement of the slider 4, so that the movable contacts 5 carried by the slider 4 are moved to switch the electric circuits.

As will be seen from the foregoing description, according to the invention, the click container is attached to the switch frame by positioning the tongues provided at the rear portion of the switch frame in the corresponding grooves formed in the click container. Therefore, the switch can be assembled with a simple operation of inserting the tongues into the grooves, without necessitating the spreading of the switch frame which has been necessary in the prior art, contributing to the practical advantages of reduced cost of manufacture and facilitated assembling.

What is claimed is:

1. A lever switch comprising:

(a) a frame having oppositely facing positioning tongues formed in a rear portion thereof;

(b) a slider within said frame, said slider having a driving part;

(c) a click container within said frame, said container having a click member therein;

(d) a driving lever pivotally secured to said frame, said lever having a driving projection adapted for engagement with said driving part of said slider and a cam portion adapted for engagement with said click member;

(e) said click container having grooves formed therein, said grooves corresponding to said tongues whereby said click container may be attached to said frame by inserting said tongues into said grooves.

* * * * *